US011007539B2

(12) United States Patent
Weingartner et al.

(10) Patent No.: US 11,007,539 B2
(45) Date of Patent: May 18, 2021

(54) DISCONTINUOUSLY OPERATED CENTRIFUGE

(71) Applicant: ANDRITZ FIEDLER GMBH, Regensburg (DE)

(72) Inventors: Markus Weingartner, Bernhardswald (DE); Philip Schofield, Cobham (GB)

(73) Assignee: ANDRITZ FEDLER GMBH, Regensburg (DE)

( * ) Notice: Subject to any disclaimer, the term of this patent is extended or adjusted under 35 U.S.C. 154(b) by 0 days.

(21) Appl. No.: 16/634,483

(22) PCT Filed: Oct. 4, 2018

(86) PCT No.: PCT/EP2018/000462
§ 371 (c)(1),
(2) Date: Jan. 27, 2020

(87) PCT Pub. No.: WO2019/076474
PCT Pub. Date: Apr. 25, 2019

(65) Prior Publication Data

US 2020/0179950 A1 Jun. 11, 2020

(30) Foreign Application Priority Data

Oct. 16, 2017 (DE) ..... 10 2017 009 589.2
Oct. 2, 2018 (DE) ..... 10 2018 007 790.0

(51) Int. Cl.
*B04B 7/12* (2006.01)
*B04B 7/18* (2006.01)

(52) U.S. Cl.
CPC . *B04B 7/12* (2013.01); *B04B 7/18* (2013.01)

(58) Field of Classification Search
CPC .... B04B 7/12; B04B 7/18; B04B 3/00; B04B 7/16

(Continued)

(56) References Cited

U.S. PATENT DOCUMENTS 1,625,377 A 4/1927 Roberts
3,955,754 A * 5/1976 Schaper ..... B04B 7/18 494/36

(Continued)

FOREIGN PATENT DOCUMENTS

DE 1916280 B1 3/1969
DE 7519445 U 11/1975

(Continued)

OTHER PUBLICATIONS

International Search Report issued by the European Patent Office in International Application PCT/EP2018/000462 dated Oct. 4, 2018.

*Primary Examiner* — Walter D. Griffin
*Assistant Examiner* — Shuyi S. Liu
(74) *Attorney, Agent, or Firm* — Henry M. Feiereisen LLC

(57) ABSTRACT

A discontinuously operated centrifuge, in particular sugar or starch centrifuge, includes a rotating, cylindrical centrifuge basket having a casing provided with openings and having an upper open end. An inner screen element formed as a composite unit of a screen mat and a support mat is insertable as a prefabricated, single-piece screen element into the centrifuge basket via the upper open end thereof. The screen element has ends abutting in a circumferential direction within the centrifuge basket, with axially extending end strips attached to the abutting ends of the screen element. A closure element in the form of an axially extending clamping strip cooperates with the end strips so as to lock and radially brace the screen element against the centrifuge basket casing. Attached on the centrifuge basket is an upper limiting flange, with an annular cover being screwed onto an upper limiting flange for securing the screen element.

25 Claims, 11 Drawing Sheets

(58) Field of Classification Search
USPC ..... 127/19; 210/360.1, 380.1, 483; 494/81
See application file for complete search history.

(56) References Cited

U.S. PATENT DOCUMENTS

| | | | | |
|---|---|---|---|---|
| 7,335,302 | B2 | 2/2008 | Bartsch et al. | |
| 2006/0207926 | A1* | 9/2006 | Bartsch | B04B 3/00 210/360.1 |
| 2014/0256529 | A1 | 9/2014 | Westendarp et al. | |
| 2016/0325207 | A1* | 11/2016 | Trench | B04B 3/04 |

FOREIGN PATENT DOCUMENTS

| | | | |
|---|---|---|---|
| DE | 8811771 | U1 | 12/1988 |
| DE | 19842042 | A1 | 3/2000 |
| DE | 1693112 | B1 | 2/2005 |
| DE | 2782679 | A1 | 11/2011 |
| GB | 425716 | A | 3/1935 |
| GB | 0536953 | A2 | 4/1993 |
| WO | WO2016025862 | A1 | 2/2016 |

* cited by examiner

DISCONTINUOUSLY OPERATED CENTRIFUGE

CROSS-REFERENCES TO RELATED APPLICATIONS

This application is the U.S. National Stage of International Application No. PCT/EP2018/000462, filed Oct. 4, 2018, which designated the United States and has been published as International Publication No. WO 2019/076474 A1 and which claims the priorities of German Patent Applications, Serial No. 10 2017 009 589.2, filed Oct. 16, 2017 and Serial No. 10 2018 007 790.0, filed Oct. 2, 2018, pursuant to 35 U.S.C. 119(a)-(d).

BACKGROUND OF THE INVENTION

The invention is concerned with a discontinuously operated centrifuge, intended in particular for the sugar or starch industry. The discontinuously operated centrifuge includes a rotating, cylindrical centrifuge basket having a casing formed with openings. The number of openings, which are used for dewatering the sugar molasses and the sugar crystals, is relatively small in the known designs for reasons of stability of the centrifuge basket. As inner screen element, a punched and drilled perforated plate is used. Since the small number of openings thus results in a small open area, each individual opening has the additional disadvantage that during sugar processing, the crystals slide during dewatering from opening to opening and even become crushed hereby, so that the efficiency and the yields are reduced. The sliding from opening to opening during dewatering causes moreover increased wear of the screen element, so that its service life decreases.

WO 2016/025862 A1 discloses a discontinuously operated centrifuge, in particular for the sugar or starch industry, according to the preamble of claim 1. This discontinuously operated centrifuge has a rotating, cylindrical centrifuge basket and an inner screen element. Furthermore, the centrifuge basket has a casing provided with openings and the inner screen element is formed as a slotted screen mat. The screen element is hereby subdivided into circumferential sections or circumferential segments so as to be able to introduce and insert these sections into the small upper centrifuge basket openings between drive shaft and upper cylinder flange. This prior art is mainly concerned with the optimization of the connecting elements (closure elements) of the circumferential sections of the screen element in the centrifuge basket. There is thus shown a screen element which is subdivided into a plurality of circumferential sections. Thus a number of joints are established between the circumferential sections. However, the joints are disadvantageous because they represent a potential weak point from a manufacturing point of view. Furthermore, each joint reduces the free open area of the screen element and therefore reduces effectiveness and performance of the centrifuge. Furthermore, each joint has gaps and cavities where sugar crystals can settle and eventually also cause cross-contamination by molasses. Each joint can also adversely affect the balance quality of the centrifuge basket as a result of manufacturing tolerances or contaminations during the centrifuging process. Finally, each joint increases manufacturing costs and the manufacturing depth during production of such screen elements, which include a screen mat and a support mat.

EP 2 782 679 B1 discloses a rotating, cylindrical centrifuge basket with openings for discharge of liquid produced during centrifugation. These openings have a cross section with an elliptical shape.

DE 1 916 280 B1 proposes, for mechanical reasons, to provide the openings with an elliptical cross section. As a result, stress in the centrifuge casing in the region of the openings can be reduced, and durability and stability of the entire centrifuge basket can be improved. In the case of continuously operating centrifuges, elliptical openings, i.e. openings with an elliptical cross section, are known from EP 1 693 1 12 B1 For further optimization of the centrifuge casing according to EP 2 782 679 B1, it is proposed that the openings have a cross section with an elliptical shape such that the openings on the inside of the basket are smaller than the openings on the outer circumference of the basket. The elliptical opening is thus configured such that the cross sections increase from the inside to the outside. In addition, it is proposed that the width of the openings on the inside is approximately equal to the diameter on the outside.

EP 536 953 A2 discloses a centrifuge basket for a discontinuously operated centrifuge, which has a casing provided with openings and is externally reinforced by a plurality of reinforcing rings which surround the casing. The reinforcing rings are arranged in axial direction at regular intervals and are correspondingly configured and dimensioned.

The invention is directed to provide a discontinuously operated centrifuge, in particular sugar or starch centrifuge with a rotating, cylindrical centrifuge basket and an inner screen element which enables an increase in yield under more efficient operating, conditions with less wear, in particular of the screen element. Furthermore, the difficulties and shortcomings shah be overcome, resulting from the large number of joints in the prior art (see in particular WO 2016/025 862 A1), since installation of the screen element in the interior space of the centrifuge basket requires for assembly a subdivision into several circumferential sections, which in turn have to be coupled with the connecting elements in an elaborate appropriate manner.

SUMMARY OF THE INVENTION

In accordance with the invention, provision is made for a discontinuously operated centrifuge, in particular sugar or starch centrifuge, having a rotating, cylindrical centrifuge basket with a casing provided with openings, an inner screen element comprised of a screen mat and a support mat, and a lower mounting flange and an upper limiting flange on the centrifuge basket, which centrifuge is characterized in that the screen element is formed as a composite unit of screen mat and support mat, is insertable as prefabricated, single-piece screen element in the centrifuge basket via its upper open end, the screen element has at the abutting ends in circumferential direction in the centrifuge basket axially extending end strips, which cooperate with a closure element in the form of an axially extending clamping strip for locking and radial bracing of the screen element against the centrifuge basket casing, and that an annular cover is screwed onto the upper limiting flange for fixation of the screen element.

In the configuration according to the invention, the centrifuge basket thus has a relatively largely dimensioned opening at the top, so that the screen element can be introduced as prefabricated single-piece composite unit of screen mat and support mat, so that the assembly of the screen element is substantially simplified and encounters only one joint essentially hi circumferential direction, thereby significantly reducing the complexity of the manufacturing process. In the configuration according to the invention, the abutting ends in circumferential direction of the centrifuge basket have axially extending end strips, which cooperate with a closure element in the form of an axially extending clamping strip for locking and radial bracing of the screen element against the centrifuge basket casing.

Thus, the difficulties and drawbacks can be eliminated, which are related to the large number of joints, as discussed above in the context of the prior art according to WO 2016/025 862 B1. Due to the large number of openings in the centrifuge basket casing in combination with the screen elements as a slotted screen mat, there is not only the advantage of exhibiting a relatively large open area, but also a faster dewatering of the molasses in the sugar industry, slower breakage of the sugar crystals, and increase in yield. Furthermore, wear of the screen element provided in the invention is also less than in the prior art.

Furthermore, provision may be made for a position safety device for securing the position of the screen element, which position safety device can be formed by positioning pins for the screen element on the clamping strip, or provision may be made for arrangement of an additional axially extending position safety strip which is offset preferably by 180° in relation to the clamping strip. This ensures that the screen element reliably remains in place.

Further preferred embodiments are set forth in dependent claims.

According to a further preferred embodiment, provision is made for a discontinuously operated centrifuge, in particular sugar or starch centrifuge, having a rotating cylindrical centrifuge basket, with a casing provided with openings and externally reinforced by a plurality of reinforcing rings in surrounding relation to the casing, and an inner screen element comprised of a screen mat and a support mat, which centrifuge is characterized in that the reinforcing rings are configured differently as a function of stress and tailored to stress. In this way, the casing of the centrifuge basket may be imparted with sufficient self-stability, despite the presence of relatively large and many openings, without unnecessarily increasing inertia of the centrifuge basket.

In particular, it has proven to be very expedient that the reinforcing rings have different ring thicknesses and/or ring heights and/or ring spacings.

Preferably, the design is such that the reinforcing rings are configured stronger at the more stressed axial ends of the centrifuge basket.

Further preferred details are set forth in dependent claims.

In summary, the centrifuge design according to the invention allows a considerably simplified assembly and production, since the screen element is prefabricated as a composite unit, and installed in the centrifuge basket in one piece, without subdivision into segments, via its upper open end. The single joint in circumferential direction is formed at the abutting ends of the screen element, with axially extending end strips being provided at these abutting ends to lock and radially brace the screen element against the centrifuge basket casing by means of a clamping strip. Also, overall assembly of the centrifuge is simplified, since finally an annular cover is screwed onto the upper limiting flange of the centrifuge basket for fixation of the screen element.

Since, furthermore, reinforcing rings, when provided, are configured differently as a function of stress and tailored to stress, for which purpose the reinforcing rings have different ring thicknesses and/or ring heights and/or ring spacings, a centrifuge is realized which has a centrifuge casing, which can have a large open area, and yet still exhibits sufficient dimensional stability and inherent stability due to the reinforcing rings. The reinforcing rings are configured stronger in particular at the axial end surfaces of the centrifuge basket, in order to withstand the greater stress there.

BRIEF DESCRIPTION OF THE DRAWING

Preferred embodiments of the invention will be explained in greater detail hereinafter with reference to the accompanying drawing, depicting a non-limiting example of a discontinuously operated sugar centrifuge.

The figures of the drawing show in:

FIG. 3 in the upper area,

FIG. 4 in the middle region,

FIG. 5 in the lower area;

DETAILED DESCRIPTION OF PREFERRED EMBODIMENTS

Figure 1:
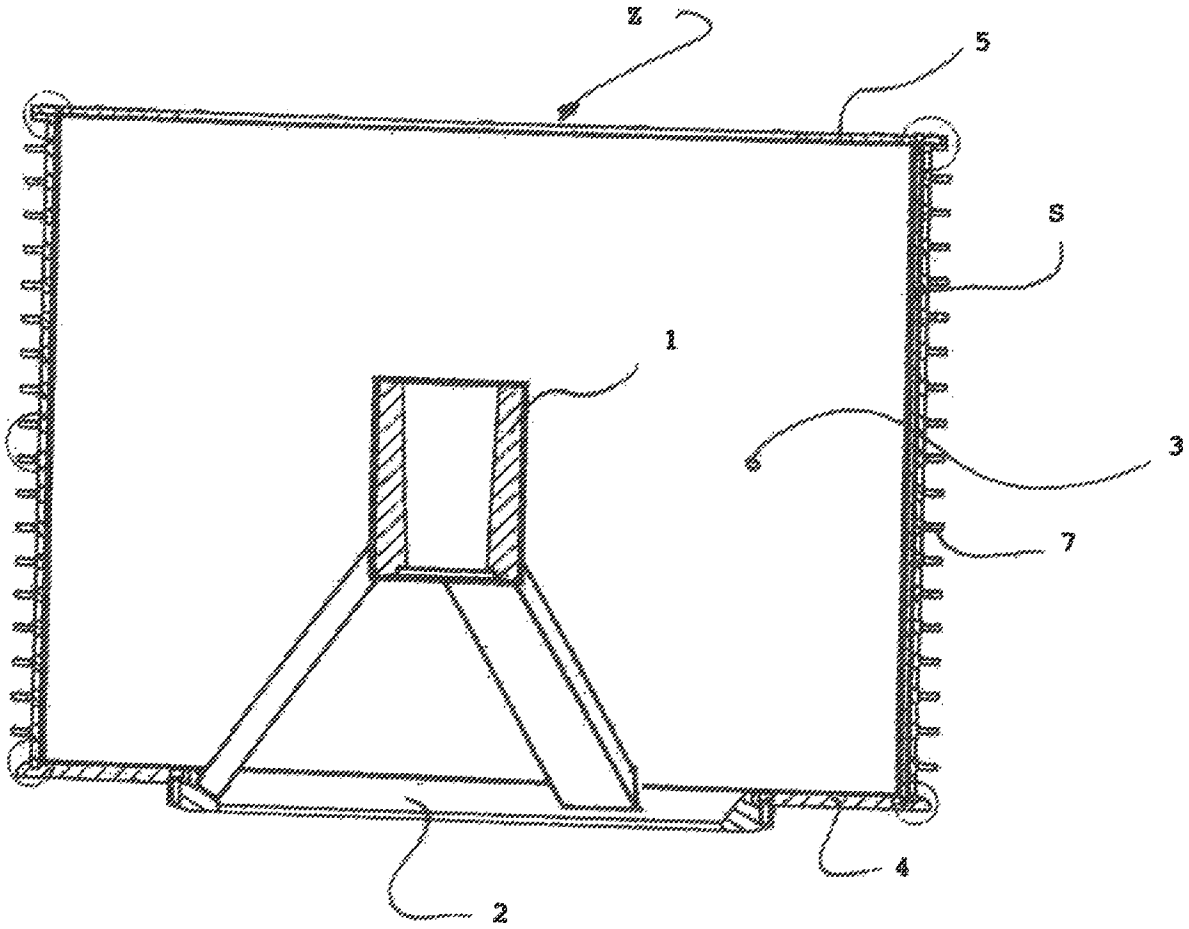
FIG. 1 a cross sectional view through a discontinuously operated centrifuge.

In the figures of the drawing, same or similar parts are given the same reference numerals.

Figure 2:
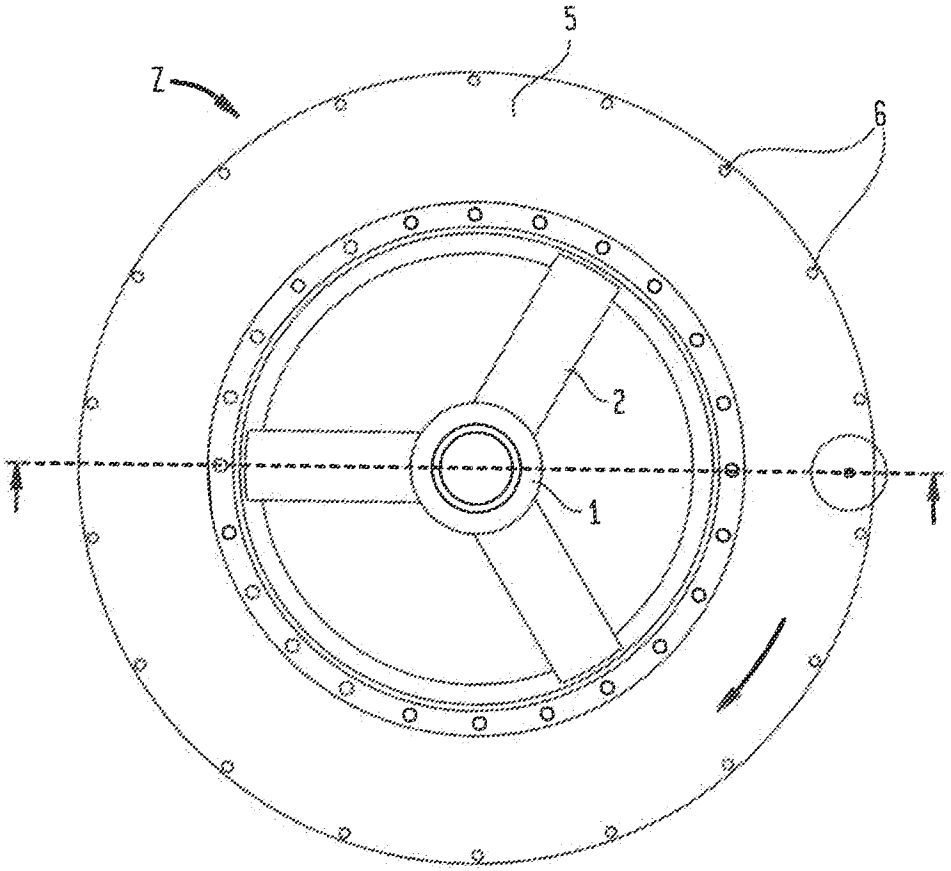
FIG. 2 a schematic top view of the centrifuge of FIG. 1.

A preferred, non-limiting embodiment of a discontinuously operated centrifuge, generally designated with the reference sign Z, is shown with reference to FIGS. 1 and 2. For motor drive, the centrifuge Z includes a hub 1 and a mounting adapter 2, which is welded to a lower mounting flange 4, to which a rotating cylindrical centrifuge basket 3 is welded, as can be seen, for example, from FIG. 5, with the welded seam being designated with 16. The centrifuge basket 3 includes a cylindrical centrifuge basket casing 8 provided with openings 9 and readily apparent in particular from FIGS. 3 to 6. In the illustrated embodiment, this cylindrical centrifuge basket casing 8, provided with openings 9, is surrounded on the outside by reinforcing rings 7. The inner screen element or the screen element located inside the centrifuge basket 3 is shown schematically in FIG. 1 and generally designated with S. Furthermore, the centrifuge Z includes an upper limiting flange 5, which is connected to the perforated, cylindrical centrifuge basket casing 8 by fastening elements, for example screws 6.

The top view of FIG. 2 shows the upper limiting flange 5 with a fastening element 6 in the form of screws, as well as the hub 1 and the mounting adapter 2. The direction of rotation of the centrifuge Z is indicated by an arrow.

As can be seen from FIGS. 3 to 6 and 7, the centrifuge construction includes the centrifuge basket casing 8 provided with openings 9 and the inner screen element, which is generally designated with S. This inner screen element S includes profiled screen wires 10 and screen support wires 11, so that the screen element S is formed as a wedge-wire screen element (bar screen element) or as a resistance-welded screen mat 12, which includes the profiled screen wires 10 and the screen support wires 11.

Furthermore, the inner screen element S, configured as a slotted screen mat, is surrounded on the outside by a supporting structure comprised of the profiled screen wires 10 and the screen support wires 11, which includes radial and axial support wires 13, 14. The radial and axial support wires 13, 14 form a wedge-wire support element (resistance-welded support mat of 13 and 14), which is generally designated with 5.

The cylindrical wedge-wire support mat 15 and the wedge-wire screen element 12 shown as a resistance-welded screen mat is fixed in the interior of the centrifuge casing 8 by means of an axial tension element 17, which is explained in more detail with reference to FIGS. 7 and 8, such that the screen element S is radially braced, fixed and locked against the centrifuge basket casing 8.

Figure 5:
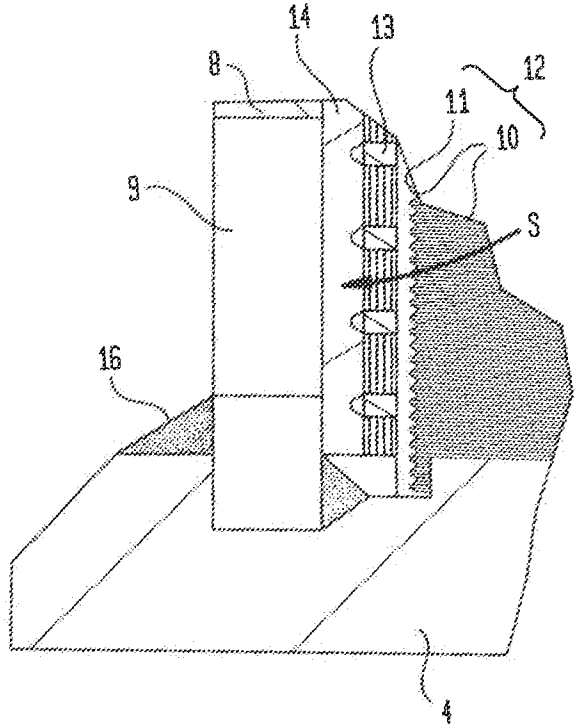
FIGS. 3, 4 and 5 schematic, enlarged cut-away views of regions of the centrifuge in FIG. 1, marked by a circle, i.e.
Figure 4:
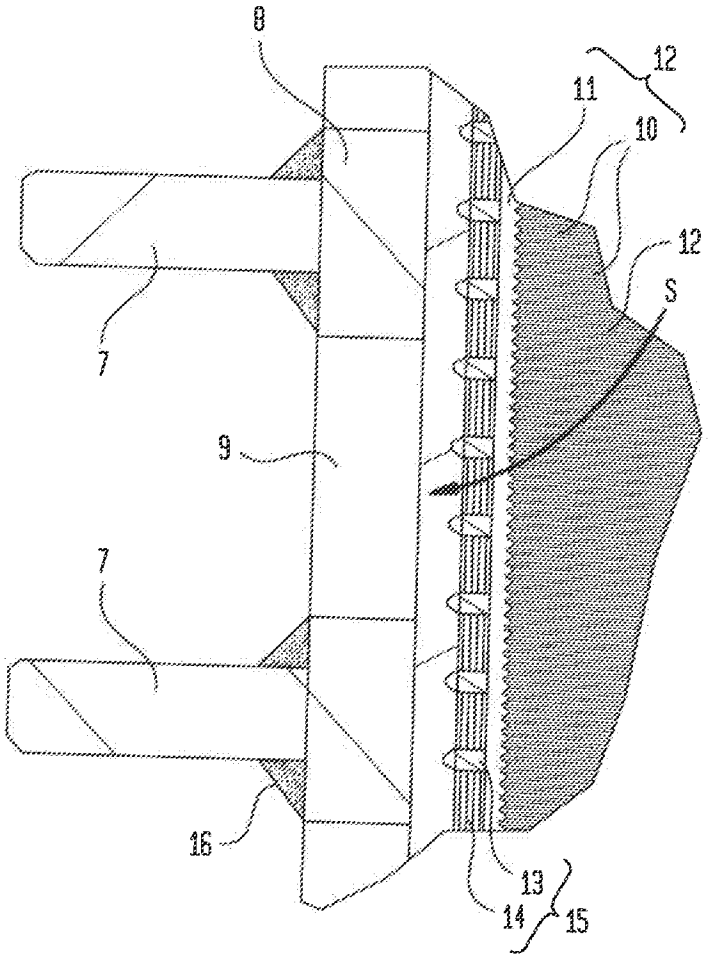
Figure 3:
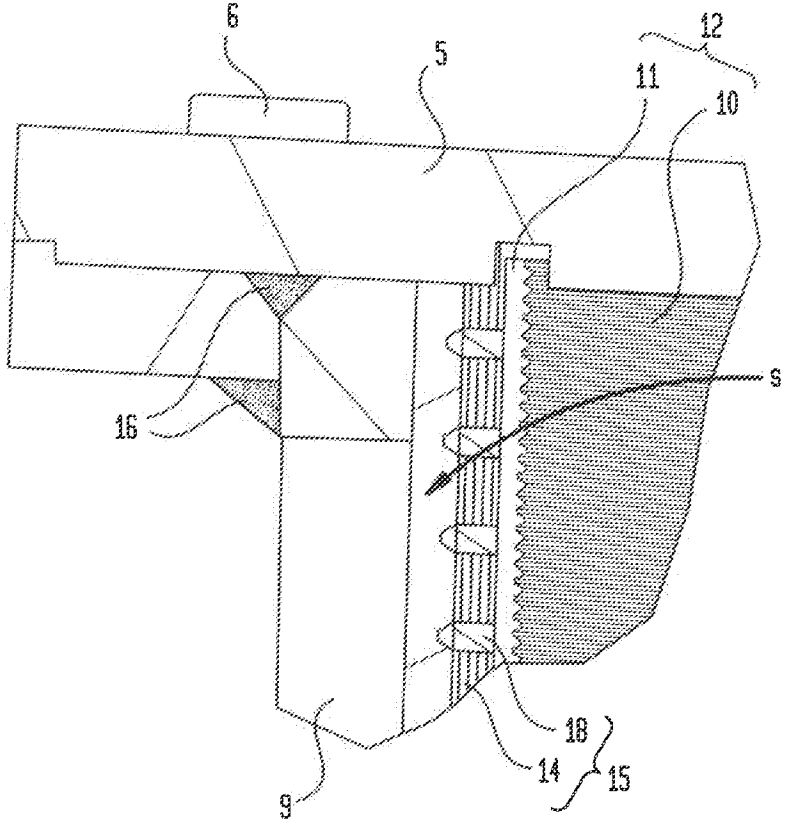

As can be seen from FIG. 3, the centrifuge basket casing 8 provided with openings 9 is fixedly connected to the upper limiting flange 5 and, as is further apparent from FIG. 5, also fixedly connected to the lower mounting flange 4 via welded seams 16.

Figure 7:
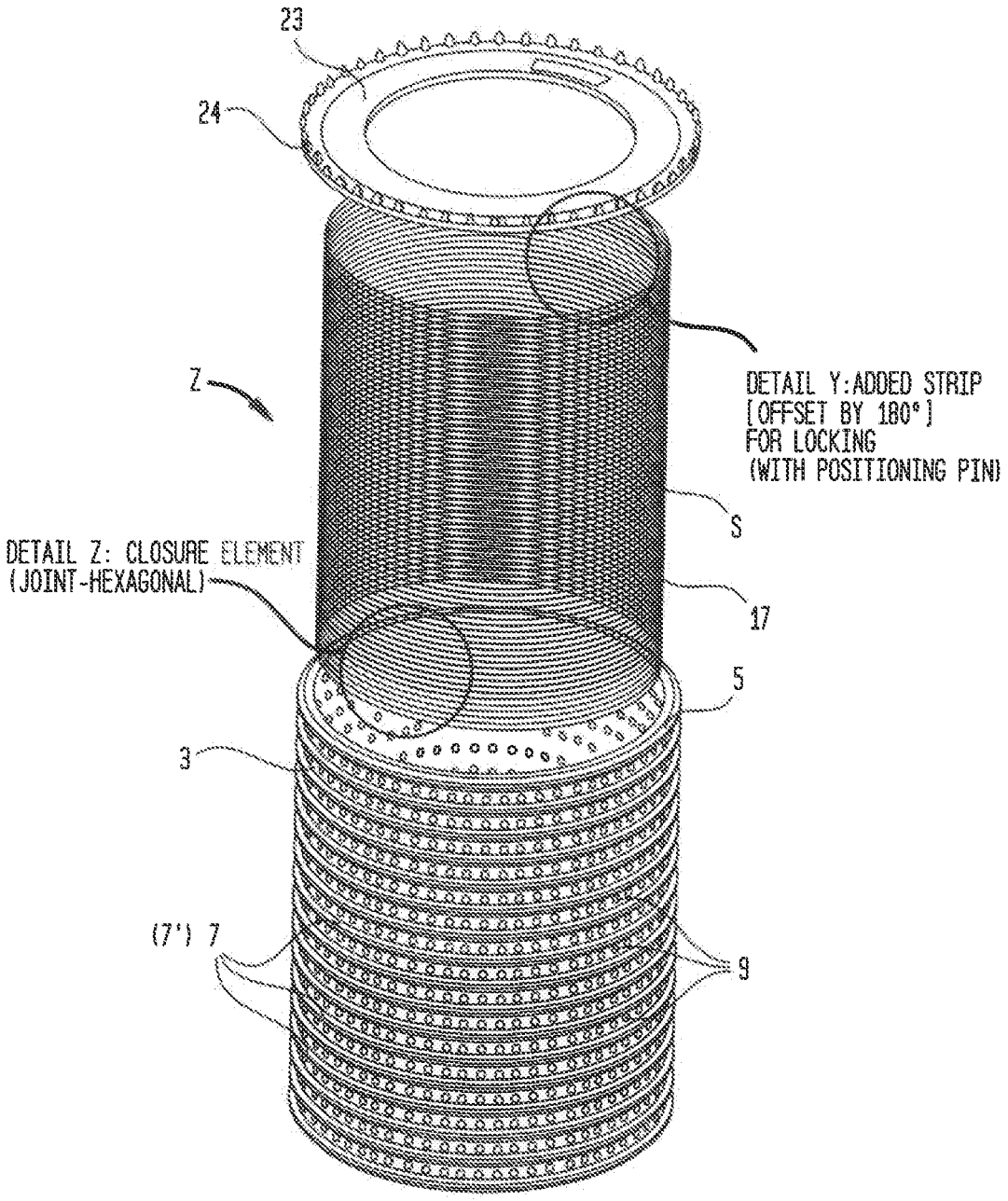
FIG. 7 an exploded perspective view of a discontinuously operated centrifuge.

FIG. 7 shows an exploded perspective view of a centrifuge Z. The screen element S, which includes the resistance-welded screen mat 12 of the wires 10 and 11 and the resistance-welded support mat 15 of the radial and axial support wires 13, 14, is configured such that the screen element S forms a composite unit of screen mat 12 and support mat 15, which is prefabricated, and as a whole (single piece) can be introduced and inserted as screen element S in the centrifuge basket 3 via its upper open end, formed by the upper limiting flange 5.

Figure 8:
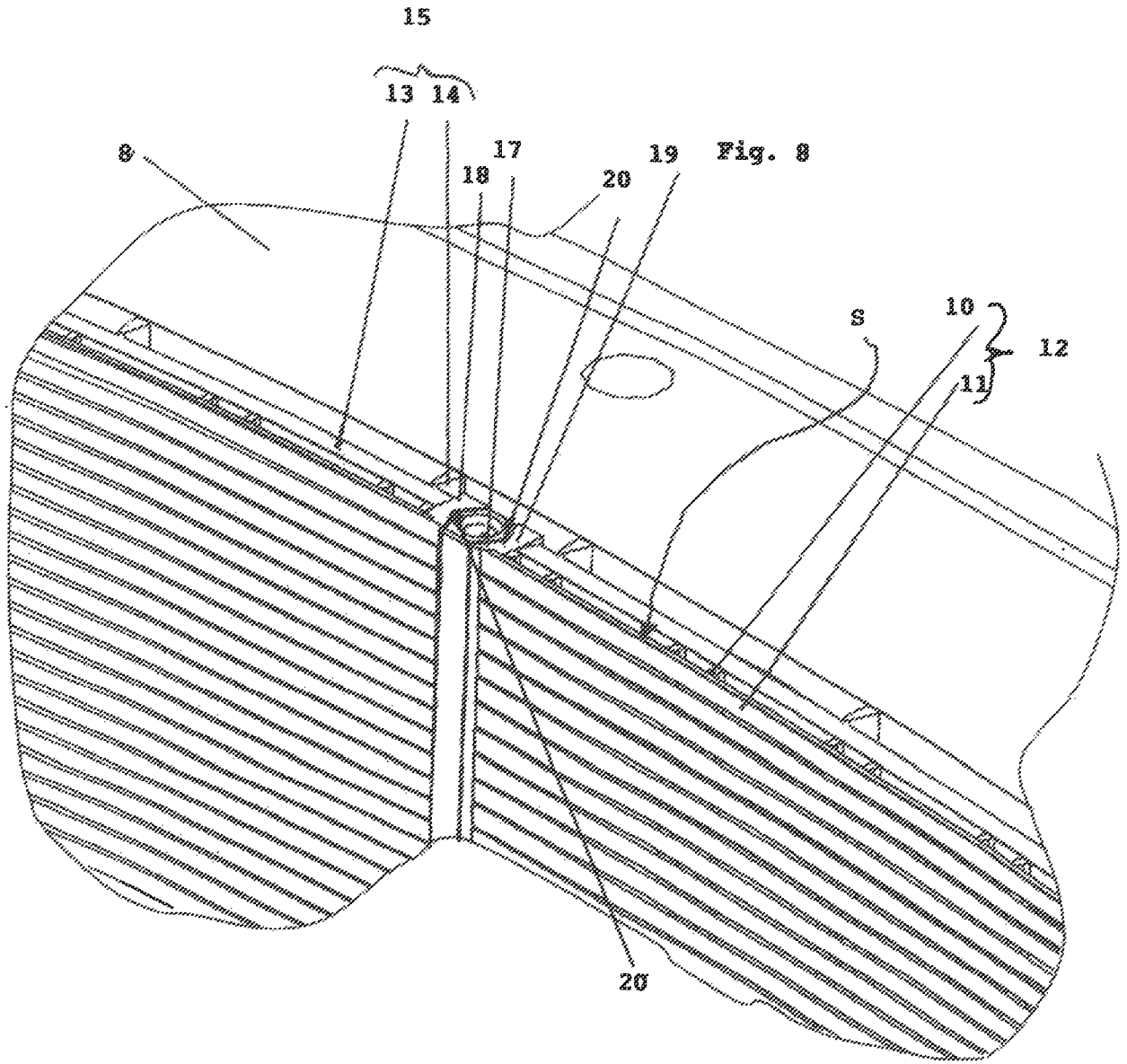
FIG. 8 a schematic perspective cutaway view of the centrifuge section designated "Z" in FIG. 7.

As is also apparent in conjunction with FIG. 8, provision is made for an axial tension element 17 in the form of an axially extending clamping strip 17 for locking a radial bracing of the screen element S. The ends 20 of the screen element 5, which abut in circumferential direction of the centrifuge basket 3, have axially extending end strips 18, 19, (see in particular FIG. 8), with which the axial tension element (clamping strip) 17 cooperates such that the screen element S is radially braced, locked and secured against the centrifuge basket casing 8.

Figure 9:
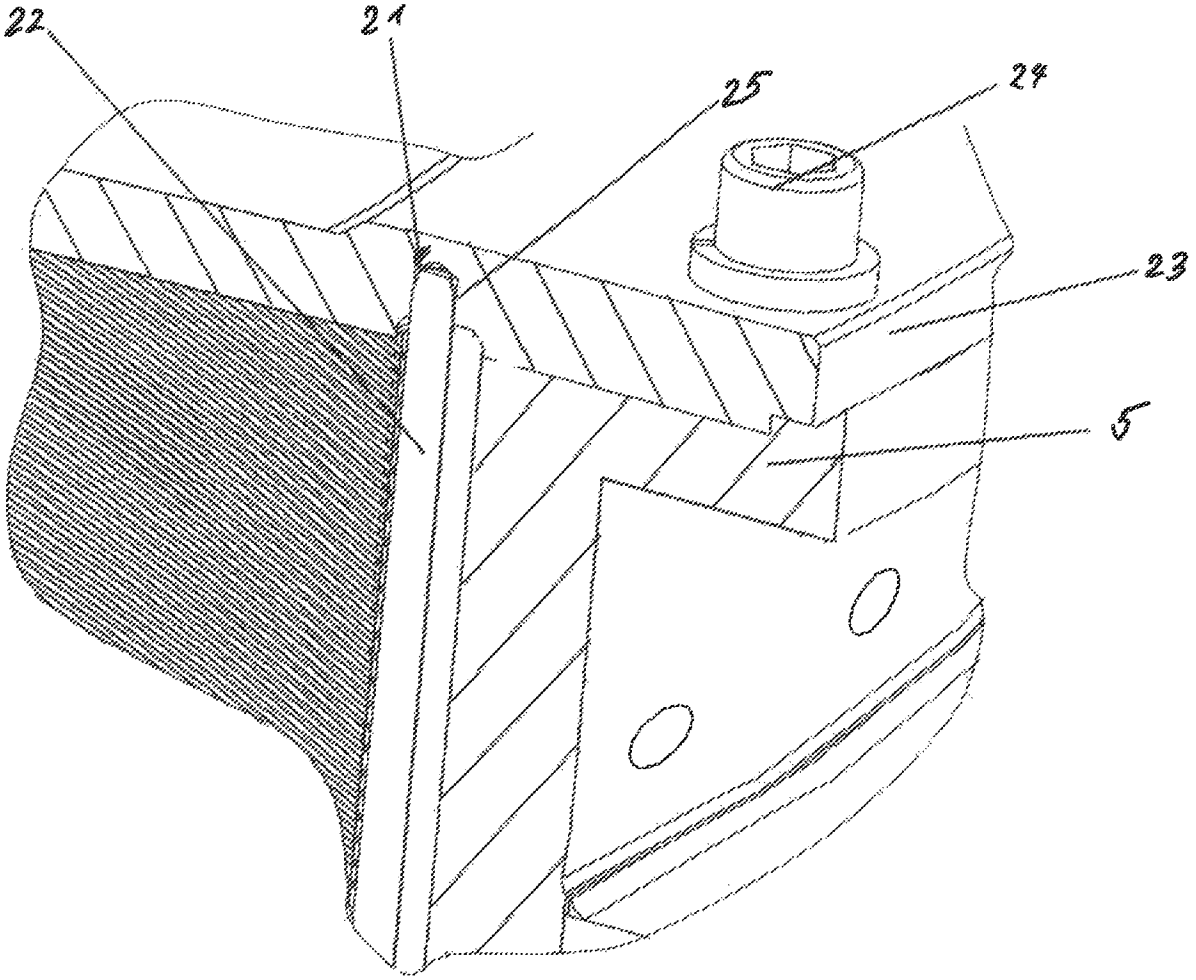
FIG. 9 a perspective, schematic, cutaway view of a centrifuge section designated "Y" in FIG. 7.
Figure 10:
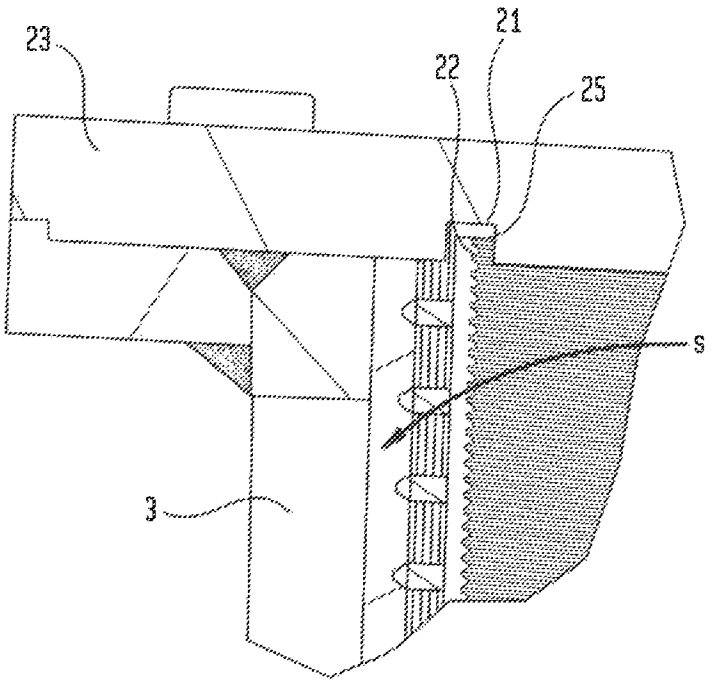
FIG. 10 an enlarged sectional view of the detail "Y" in FIG. 7 in the upper region of the centrifuge.
Figure 11:
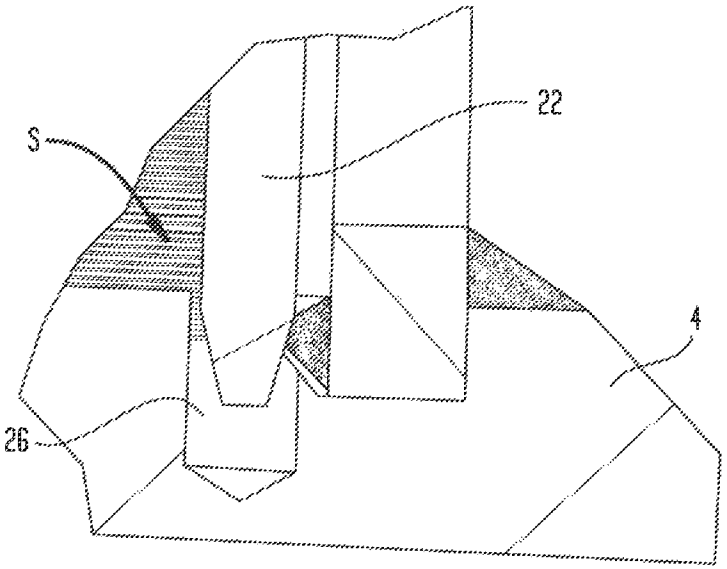
FIG. 11 a schematic, enlarged sectional view showing the detail "Y" in FIG. 7 in the lower region of the centrifuge.

As is further apparent from FIGS. 9 to 11, provision is made for a positioning device 21 which is arranged, preferably offset by approximately 180° in the circumferential direction relative to the axial tension element 17 or clamping strip 17. Involved here is, according to FIGS. 9 to 11, an additional position safety strip 22 which is offset, preferably by 180°, to the damping strip 17. Further details in this regard will then be explained in more detail hereinafter with reference to FIGS. 8 to 11, and in particular FIGS. 9 to 11.

As shown in FIG. 10, the centrifuge basket 3 has several circumferentially distributed openings 9 and a plurality of reinforcing rings 7 surrounding the casing 8 on the outside. The screen element S is inserted as a whole in this centrifuge basket 3, which has a schematically indicated mounting flange 4 on the bottom side, and is then pressed in concert with the damping strip 17 with the end strips 18, 19 of the screen element S against the inner circumference of the centrifuge basket 3 for bracing and locking.

The centrifuge Z further includes a cover-shaped ring part 23, which may also be designated as a cover ring 23, which is then ultimately screwed onto the upper limiting flange 5 via schematically shown screws 24. When these parts are all joined together and firmly connected together, the centrifuge Z is completed and can then be used for its intended purpose.

FIG. 8 shows in greater detail the detail Z in FIG. 7 as cutaway view and on an enlarged scale.

The abutting ends 20 of the screen element S can be seen there, with end strips 18, 19 being attached thereon. By means of a clamping strip or an axially extending tension dement 17, which serves as a closure element, the end strips 18, 19 are then locked at the abutting ends 20 of the screen element S against the centrifuge basket casing 8 and radially braced. This involves a preferred embodiment of a closure element for the fixation of the screen element S in the interior of the centrifuge basket 3.

Although not depicted in greater detail in FIG. 8 for reasons of clarity, positioning pins could be provided for the screen element S at the axially opposite ends of the clamping strip 17 and cooperate with the upper side with the cover ring 23 and with the bottom side with the mounting flange 4 in axially spaced-apart relationship.

According to a preferred embodiment, which can be seen from FIG. 9 in conjunction with FIG. 7, an additional position securing strip 22, preferably offset by 180° in relation to the clamping strip 17, is provided.

As can be seen from FIGS. 9, 10 and 11, the position securing strip 22 extends over the entire axial extent of the centrifuge basket 3 and slightly beyond it. According to FIG. 9, the annular cover 23 is provided therein with a recess 25 for engagement of the upper axial end of the position securing strip 22. In this way, the screen element is additionally secured again inside the centrifuge basket 3. The arrangement of the position securing strip 22, offset by approximately 180° in circumferential direction relative to the clamping strip 17, has the advantage that an unbalance caused by the end strips 18 and 19 and the clamping strip 17 can preferably be at least partially compensated.

FIG. 10 illustrates by way of a cutaway view the interaction of the position securing strip 22 with the recess 25 in the annular cover 22.

As can be seen from FIG. 11, the other axial end of the position securing strip 22 extends into an associated recess 26 in the lower welded-on mounting flange 4.

Figure 12:
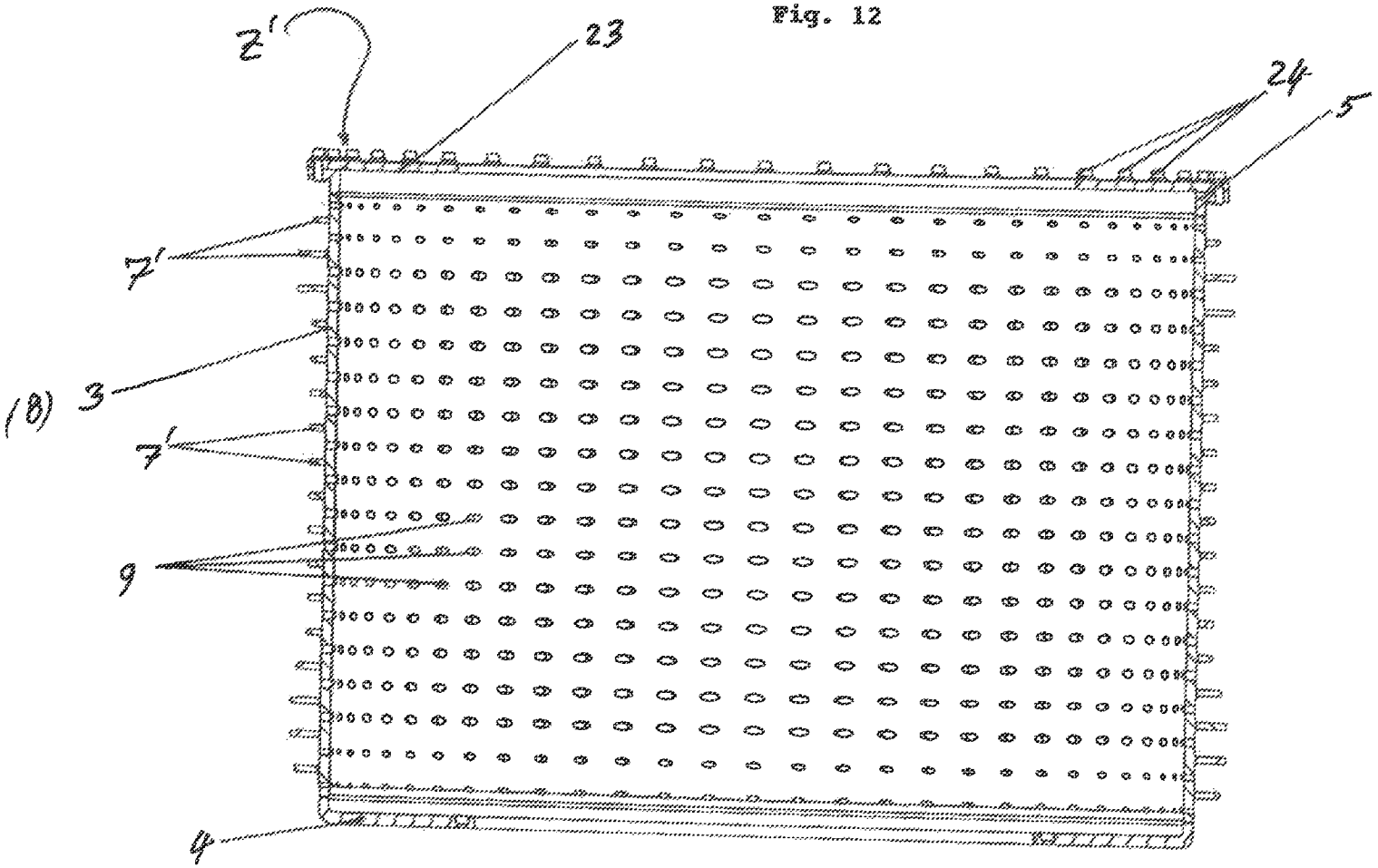
FIG. 12 a schematic sectional and side view of a centrifuge basket to illustrate differently configured reinforcing rings and openings of the centrifuge basket.

FIG. 12 illustrates schematically a centrifuge, generally designated with Z'. It becomes apparent from this FIG. 12 that the openings 9 are formed in the centrifuge basket casing 8 in the axial direction of the casing 8 at different distances (axial distances) and are sized differently. Also, the circumferential distances of the openings 9 may, optionally, vary. Reinforcing rings 7' are furthermore shown in FIG. 12 and can be designed as a function of stress or tailored to stress. FIG. 12 illustrates an embodiment, in which the reinforcing rings 7' at the axial ends of the basket 8 are sized greater, i.e. provided with a greater ring height. In a discontinuously operated centrifuge Z', the greatest stress occurs in particular during operation in the region of the axial ends of the centrifuge basket 3.

Figure 13:
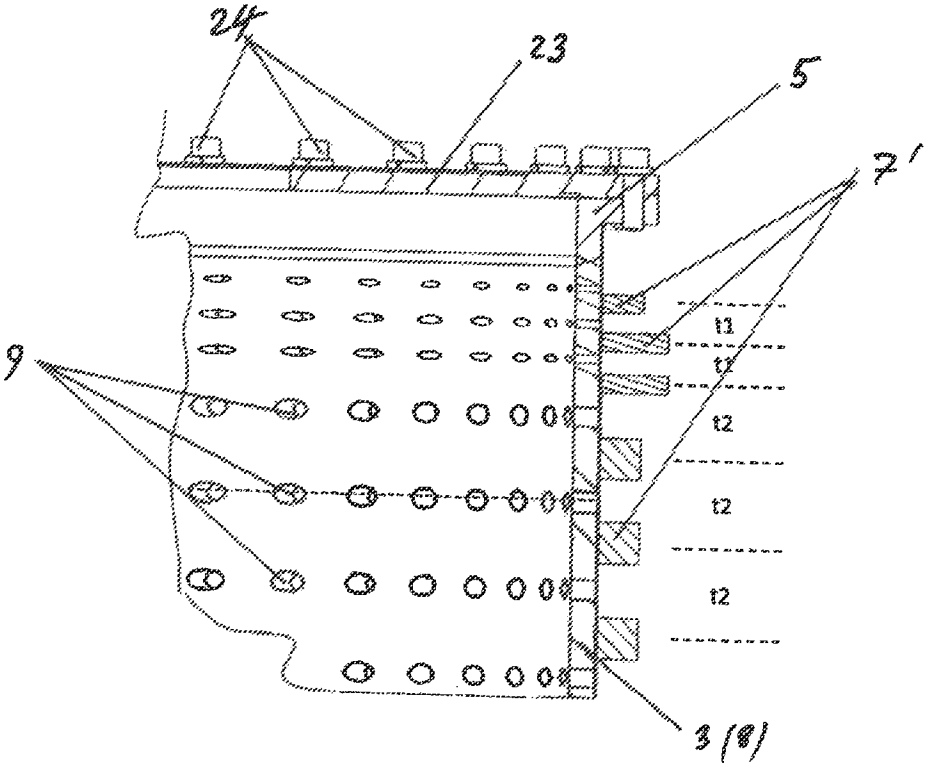
FIG. 13 a schematic sectional view for illustrating differently configured reinforcing rings and openings on and in the centrifuge basket.

As can be seen schematically from FIG. 13, the reinforcing rings can have different thicknesses and/or ring heights and/or ring spacings when configuring the reinforcing rings 7' as a function of stress or tailored to stress. The ring spacings are designated with t1 and t2. Appropriate optimization of these sizes of the reinforcing rings 7' enables the advantage to achieve even stress upon the centrifuge basket 3 and equalization of the stress.

The different ring thicknesses can be in the range of 8 mm to 30 mm, preferably in the range of 10 mm to 19 mm. The different ring heights can be in the range of 10 mm to 80 mm, preferably in the range of 20 to 60 mm. The different ring spacings t1, t2 can be in a range of 20 mm to 150 mm, preferably in a range of 40 mm to 80 mm.

Figure 6:
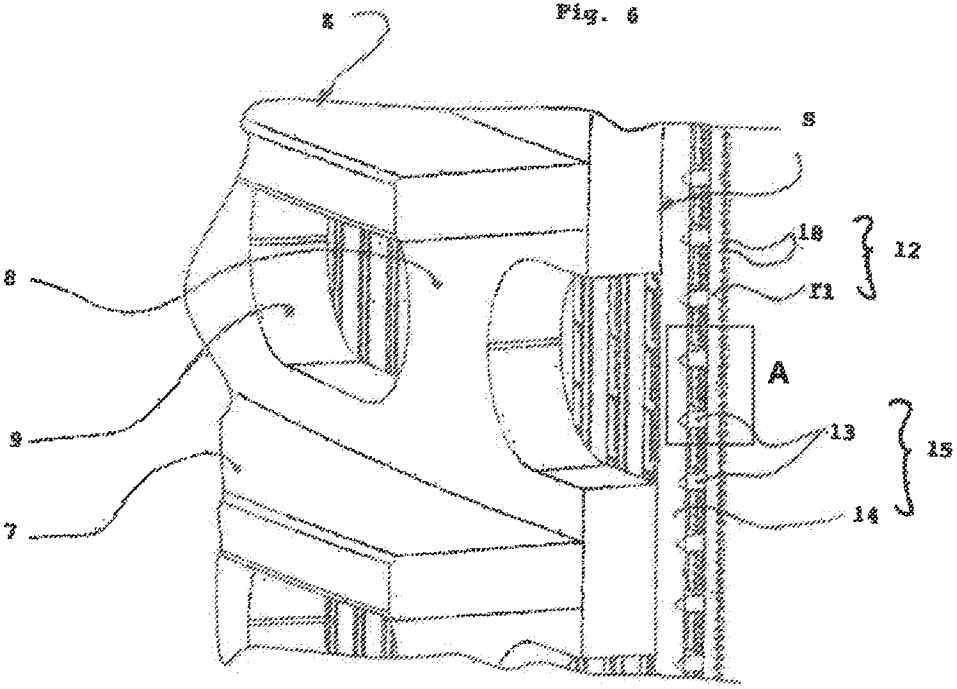
FIG. 6 a schematic, enlarged perspective cut-away view corresponding to FIG. 4.
Figure 6A:
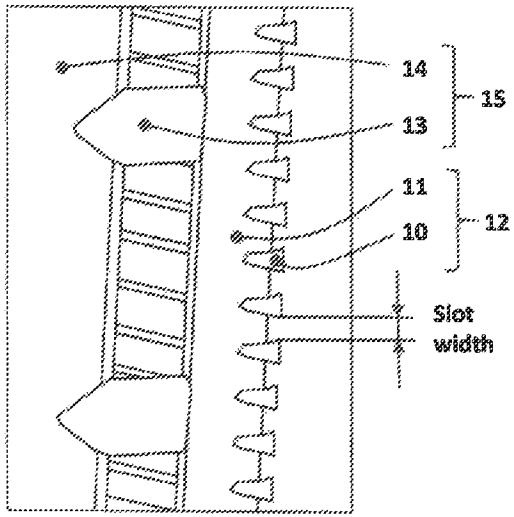
FIG. 6*a* is an enlarged detailed view of the area marked Ain FIG. 6.

As can further be seen schematically from the figures, the screen element S may have different opening widths in axial material flow direction. The opening widths of the screen element S preferably increase in material flow direction. According to a preferred embodiment, the screen mat 15 with 10, 11 has a free, open area of 10% to 50%, preferably from 20% to 50%. In particular, the screen mat 15 with 10, 11 has a slot width (FIG. 6*a*) of 0.030 mm to 0.70%, preferably from 015% to 0.5%.

The screen mat 15 with 10, 11 may include preferably profile bars with a profile bar width of 0.4 mm to 1, 5 mm, in particular from 0.5 mm to 0.8 mm.

The support mat 15 with 13, 14 preferably has a free, open area of 60% to 95%, and in particular 70% to 90%.

Openings 9 are provided in particular in the lower region of the centrifuge basket casing 8 with greater opening cross section of 400 $mm^2$ to 800 $mm^2$. The ratio of major axis to minor axis of the ellipsoidal openings 9 may be in a range of 1.5 to 4, preferably in a range of 2.0 to 2.7.

Overall, the total free open area of the centrifuge basket 3 provided with openings 9 amounts to 3% to 30%, preferably 5% to 10%.

Of course, the present invention is not limited to the afore-described preferred embodiments and their details, but numerous modifications and additions are possible, which the person skilled in the art may, optionally, carry out, without departing from the spirit of the invention. Thus, of course, the sizes of the openings 9 in the centrifuge basket casing 8 may vary in size, arrangement and number, which may depend on the particular application. Of course, the reinforcing rings 7, 7', regardless of the openings 9 in the centrifuge basket 3, can be designed differently as a function of stress and tailored to stress. Of course, combinations of both variations are also included. The particular advantage of the configuration according to the invention involves in particular the absence of several joints in the screen element S, and there is no need to subdivide the latter into circumferential segments or circumferential sections, but rather can be inserted as a one-piece, prefabricated part as screen element S in the open-top interior space of the centrifuge basket 3 and then clamped, locked and fixed with the aid of a single closure element 17, 18, 19 and optionally a positioning device 21 in the form of a position securing strip 22 against the inner surface of the casing 8. This appreciably simplifies the assembly of such a centrifuge Z or Z', and further such a centrifuge Z, Z' can also be operated more effectively. An annular cover member 23 is then provided for the upper axial closure of the centrifuge Z, Z', which is preferably fastened with screws 24 on the upper limiting flange 5.

What is claimed is:

1. A discontinuously operated centrifuge, comprising:

a rotating, cylindrical centrifuge basket having a casing provided with openings;

a plurality of reinforcing rings placed outside in surrounding relation to the casing of the centrifuge basket for reinforcing the casing, said reinforcing rings being configured as a function of stress and tailored to stress; and an inner screen element comprised of a screen mat and a support mat and insertable into the centrifuge basket, wherein the reinforcing rings have different ring thicknesses and/or ring heights and/or ring spacings.

2. The discontinuously operated centrifuge of claim 1, wherein the screen element defines an axis and has opening widths which are different in as material flows in a direction of the axis.

3. The discontinuously operated centrifuge of claim 2, wherein the opening widths of the screen element increase in the direction of the axis.

4. The discontinuously operated centrifuge of claim 1, wherein the screen mat has a free, open area of 10% to 50%.

5. The discontinuously operated centrifuge of claim 1, wherein the screen mat has a slot width of 0.030 mm to 0.70 mm.

6. The discontinuously operated centrifuge of claim 1, wherein the support mat has a free, open area of 60% to 95%.

7. The discontinuously operated centrifuge of claim 1, wherein the openings are configured in the centrifuge basket casing of elliptical shape.

8. The discontinuously operated centrifuge of claim 7, wherein the centrifuge basket casing has a lower region in which the openings have a cross section in a range of 200 $mm^2$ to 300 $mm^2$.

9. The discontinuously operated centrifuge of claim 7, wherein the centrifuge basket casing has a central region in which the openings have a cross section of 400 $mm^2$ to 800 $mm^2$.

10. The discontinuously operated centrifuge of claim 7, wherein the openings are defined by a major axis and a minor axis, with a ratio of the major axis to the minor major axis being 1.5 to 4.

11. The discontinuously operated centrifuge of claim 1, wherein the centrifuge basket has a total free, open area which is 3% to 30%.

12. The discontinuously operated centrifuge of claim 1, wherein the reinforcing rings have a ring thickness which is greater at axial ends of the centrifuge basket.

13. The discontinuously operated centrifuge of claim 1, wherein the different ring thicknesses are in a range of 8 mm to 30 mm.

14. The discontinuously operated centrifuge of claim 1, wherein the different ring heights are in a range of 10 mm to 80 mm.

15. The discontinuously operated centrifuge of claim 1, wherein the different ring spacings are in a range of 20 mm to 150 mm.

16. The discontinuously operated centrifuge of claim 1, constructed in the form of a sugar or starch centrifuge.

17. The discontinuously operated centrifuge of claim 1, wherein the different ring thicknesses are in a range of 10 mm to 19 mm.

18. The discontinuously operated centrifuge of claim 1, wherein the different ring heights are in a range of 20 mm to 60 mm.

19. The discontinuously operated centrifuge of claim 1, wherein the different ring spacings are in a range of 40 mm to 80 mm.

20. The discontinuously operated centrifuge of claim 1, wherein the screen mat has a free, open area of 20% to 50%.

21. The discontinuously operated centrifuge of claim 1, wherein the screen mat has a slot width of 0.15 mm to 0.5 mm.

22. The discontinuously operated centrifuge of claim 1, wherein the support mat has a free, open area of 70% to 90%.

23. The discontinuously operated centrifuge of claim 7, wherein the openings are configured in the centrifuge basket casing of different size.

24. The discontinuously operated centrifuge of claim 7, wherein the openings are defined by a major axis and a minor axis, with a ratio of the major axis to the minor major axis being 2.0 to 2.7.

25. The discontinuously operated centrifuge of claim 1, wherein the centrifuge basket has a total free, open area which is 5% to 10%.

* * * * *